US011472048B2

(12) United States Patent
Weschta et al.

(10) Patent No.: US 11,472,048 B2
(45) Date of Patent: Oct. 18, 2022

(54) PERSONAL CARE DEVICE WITH PIVOTABLE TREATMENT HEAD

(71) Applicant: Braun GmbH, Kronberg (DE)

(72) Inventors: Martin Weschta, Hanau (DE); Peter Junk, Schmitten (DE); Martin Diehl, Bad Vilbel (DE); Pedro Sanchez Martinez, Kronberg (DE); Alexander Hasse, Radebeul (DE)

(73) Assignee: Braun GMBH, Kronberg (DE)

( * ) Notice: Subject to any disclaimer, the term of this patent is extended or adjusted under 35 U.S.C. 154(b) by 282 days.

(21) Appl. No.: 16/803,131

(22) Filed: Feb. 27, 2020

(65) Prior Publication Data

US 2021/0268674 A1 Sep. 2, 2021

(51) Int. Cl.

| | |
|---|---|
| ***B26B 19/14*** | (2006.01) |
| ***B26B 19/38*** | (2006.01) |
| *A45D 26/00* | (2006.01) |

(52) U.S. Cl.

CPC ..... *B26B 19/146* (2013.01); *B26B 19/386* (2013.01); *A45D 26/0028* (2013.01); *A45D 2026/008* (2013.01)

(58) Field of Classification Search

CPC ... B26B 19/146; B26B 19/386; B26B 21/225; B26B 21/521; A45D 26/0028; A45D 2026/008

See application file for complete search history.

(56) References Cited

U.S. PATENT DOCUMENTS

| | | | | |
|---|---|---|---|---|
| 5,745,995 | A | 5/1998 | Yamashita et al. | |
| 2007/0214662 | A1* | 9/2007 | Efthimiadis | B26B 21/38 30/527 |
| 2017/0282392 | A1* | 10/2017 | Maimone | B26B 21/52 |

FOREIGN PATENT DOCUMENTS

| | | | |
|---|---|---|---|
| CN | 1274311 | A | 11/2000 |
| EP | 3398737 | | 11/2018 |
| GB | 2116470 | A | 9/1983 |
| JP | 2011229641 | A | 11/2011 |

OTHER PUBLICATIONS

PCT Search Report and Written Opinion for PCT/IB2019/059937, dated Feb. 5, 2020, 13 pages.
European search report dated Jul. 3, 2019.

* cited by examiner

*Primary Examiner* — Todd J Scherbel
(74) *Attorney, Agent, or Firm* — Kevin C. Johnson; StefanMichael Schneider

(57) ABSTRACT

This disclosure is concerned with a personal care device with a treatment head being pivot-mounted around a pivot axis, the personal care device having a pin having a pin head, a cam element having a cam surface, a spring element biasing the pin head and the cam surface against each other, wherein the cam surface is shaped such that it defines a rest position at which the biasing spring force provided by the spring element with which the pin head and the cam surface are pushed against each other has a non-zero minimum value, and wherein a pivoting of the head around the pivot axis causes the pin head to move along the cam surface and the cam surface is further shaped such that the spring force pushing the pin head and the cam surface against each other increases with increasing pivoting angle.

15 Claims, 4 Drawing Sheets

A - A

PERSONAL CARE DEVICE WITH PIVOTABLE TREATMENT HEAD

FIELD OF THE INVENTION

The present application is concerned with a personal care device having a treatment head arranged for pivoting around a pivot axis with respect to a body of the personal care device.

BACKGROUND OF THE INVENTION

Document EP 1 372 428 A1 generally describes an epilator having a head and a housing, where the head is mounted at the housing so that it can pivot around a rest position. A spring is mounted between head and housing so that the head is forced back into the rest position once it is pivoted out of the rest position.

It is an object of the present description to provide a personal care device having a head arranged for swiveling around a swivel axis with respect to a body of the device comprising an improved or at least alternate provision of a return force providing arrangement.

SUMMARY OF THE INVENTION

In accordance with one aspect, a personal care device with a treatment head being pivot-mounted around a pivot axis with respect to a body of the personal care device, the personal care device having a pin having a pin head, the pin being provided at one of the treatment head or body, a cam element having a cam surface being provided at the other one of the treatment head or body, a spring element biasing the pin head and the cam surface against each other, wherein the pin head is in contact with the cam surface and the cam surface is shaped such that it defines a rest position at which the biasing spring force provided by the spring element with which the pin head and the cam surface are pushed against each other has a non-zero minimum value, and wherein a pivoting of the head around the pivot axis causes the pin head to move along the cam surface and the cam surface is further shaped such that the spring force pushing the pin head and the cam surface against each other increases with increasing pivoting angle.

BRIEF DESCRIPTION OF THE DRAWINGS

The present disclosure is further elucidated by a detailed description of example embodiments and with reference to figures. In the figures

DETAILED DESCRIPTION OF THE INVENTION

Figure 1:
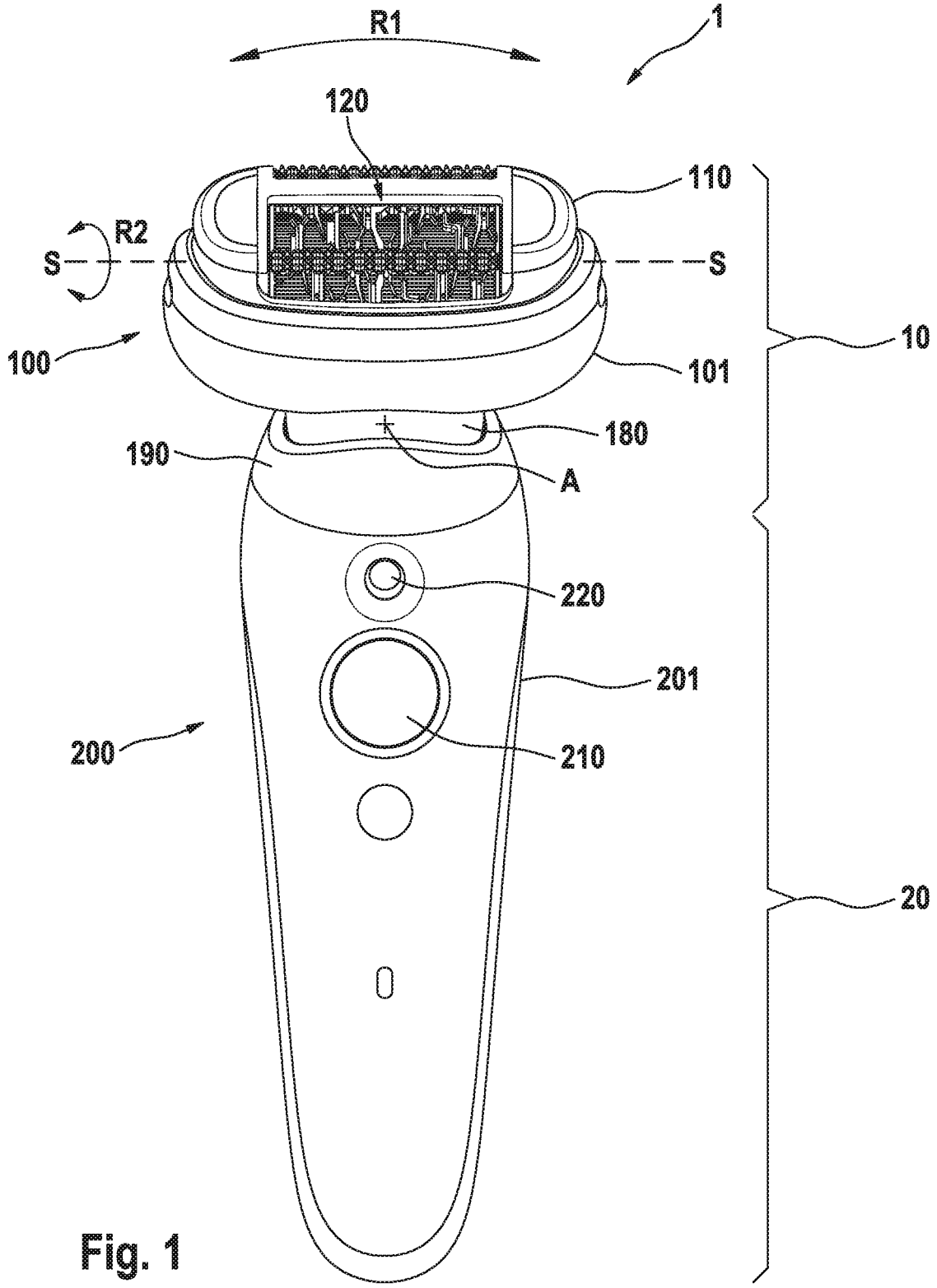
FIG. 1 is a depiction of an example personal care device realized as an epilation device.

In the context of the present description "personal care" shall mean the nurture (or care) of the skin and of its adnexa (i.e. hairs and nails) and of the teeth and the oral cavity (including the tongue, the gums etc.), where the aim is on the one hand the prevention of illnesses and the maintenance and strengthening of health ("care") and on the other hand the cosmetic treatment and improvement of the appearance of the skin and its adnexa. It shall include the maintenance and strengthening of wellbeing. This includes skin care, hair care, and oral care as well as nail care. This further includes other grooming activities such as beard care, shaving, and depilation. A "personal care device" thus means any device for performing such nurturing or grooming activity, e.g. (cosmetic) skin treatment devices such as skin massage devices or skin brushes; wet razors; electric shavers or trimmers; electric epilators; and oral care devices such as manual or electric toothbrushes, (electric) flossers, (electric) irrigators, (electric) tongue cleaners, or (electric) gum massagers. This shall not exclude that the proposed personal care system may have a more pronounced benefit in one or several of these nurturing or device areas than in one or several other of these areas. In the below description with reference to the figures, an epilation device was chosen to present details of the proposed personal care device. To the extent in which the details are not particular to an epilation device, the proposed technology can be used in any other personal care device.

The present disclosure is concerned with a personal care device that has a treatment head and a handle, where the treatment head can be swiveled or pivoted with respect to the handle around a swivel or pivot axis. The treatment head has a rest position (which may also be called a center position in case the rest position is about centric with respect to two swivel directions) out of which the head can be swiveled or pivoted into a least one angular direction against a return spring force provided by a spring element. The treatment head and the body are biased against each other in the rest position by a biasing force that needs to be overcome to swivel the head out of the rest position. The biasing force and the return spring force are provided by a spring element acting between a pin and a cam element, where the pin has a pin head that is in contact with a cam surface of the cam element. The spring element biases the pin head and the cam surface against each other with a certain non-zero minimal value (e.g. 2 N). While it is here mentioned that the personal care device has one spring element, this only means that one spring element is needed, but this shall not exclude that further spring elements are used to provide the total spring return force. In order to pivot the treatment head around the pivot axis, first the biasing force needs to be overcome and then the pin head glides over the cam surface if the applied force increases further. The biasing force thus provides a good feedback to the user as first the biasing force needs to be overcome before the head indeed pivots. In case of a spring just providing a return force, but no biasing force, the pivoting starts once a force is applied. Without intended limitation, the biasing force may generally be in a range of between 0.5 N and 8 N, in particular in a range of between 1.0 N and 5.0 N, further in particular in a range of between 1.5 N and 4.0 N, and even further in particular in a range of between 2.0 N and 3.0 N. Without intended limitation, the spring constant of the spring element may be in a range of between 0.05 N/mm and 1.0 N/mm, in particular in a range of between 0.1 N/mm and 0.4 N/mm, and further in particular in a range of between 0.15 N/mm and 0.25 N/mm. While in the discussed embodiments, the biasing force pushes the pin head against the cam surface, this shall not exclude that the cam surface is biased against the pin head, i.e. where the cam element can move, and the pin head can only pivot.

The cam surface is in particular shaped such that the spring force applied by the spring element increases with increasing pivot angle. Here, the shape of the cam surface is such that the distance between the pivot axis and the cam surface decreases and thus the pin is forced to move towards the pivot axis (or the cam element is forced to move away from the pivot axis) and by this motion the spring element is deformed in a manner that the spring force with which the pin head is pushed against the cam surface is increased. In case the cam surface would follow a circular function with respect to the pivot axis (i.e. the cam surface would be a portion of circle with the pivot axis being in the center of the circle), neither the pin nor the cam element would move, and the spring force would not change. The cam surface may follow any arbitrary function in dependence from the pivot angle as long as the distance between cam surface and pivot axis is essentially monotonously increased. The increasing spring force acts against the deflection of the treatment head and tries to return the treatment head into the rest position. The spring element may be a coil spring that is compressed when the pin moves towards the swivel axis to increase the spring force. But the spring element may also be a leaf spring that is bent, a torsion spring that is twisted etc. As already said, instead of one spring element, two or more spring elements may be used. The cam surface may be shaped such that the distance between cam surface and pivot axis decreases linearly with the pivot angle. The cam surface may also be shaped so that any other distance decreasing function is achieved. This shall not exclude that the cam surface provides for one or several lock positions at lock pivot angles, where the pivot angle would be maintained without applied external force.

While in some embodiments, the treatment head can only be pivoted out of the rest position into one pivot direction, i.e. a clockwise direction or a counter-clockwise direction with respect to the rest position, the treatment head can in some embodiments be pivoted in a plane into a clockwise and into a counter-clockwise direction out of the rest position. The maximum pivot angle in clockwise direction may have the same value as the maximum pivot angle in counter-clockwise direction (e.g. 13 degrees). Alternately, the maximum pivot angle may have different values in clockwise and counter-clockwise direction (e.g. 6 degrees and 20 degrees). The personal care device may comprise at least one stopper element to mechanically limit the deflection of the treatment head out of the rest position so that a maximum pivot angle cannot be exceeded. Two stopper elements may be present in case the treatment head can be pivoted in clockwise and counter-clockwise direction.

The pin head may have a contact surface for contacting the cam surface. The contact surface may be shaped to provide an essentially point-like or line-like contact region between the contact surface of the pin head and the cam surface. The contact surface of the pin head may be shaped as a portion of a sphere or a portion of a cylinder. In some embodiments, the pin head is a cylinder or a sphere that is in particular pivotably mounted at the pin. Such a design may help to reduce friction between the contact surface of the pin head and the cam surface. The cam surface may have a depression to define the rest position. The depression may be smaller in diameter than the diameter of the pin head and in particular smaller than the size of the contact surface so that the contact surface of the pin head has two point-like or line-like contact regions with the cam surface in the rest position. In particular, the depression may start and end at the contact pints or contact lines of the contact surface of the pin head with the cam surface. This leads to a better-defined rest position and balances out tolerances.

As the pin shall in some embodiments move in linear direction towards (and away) from the pivot axis depending on the pivot direction, the pin may be guided by any suitable linear bearing that in particular pivots together with the pin. In some embodiments, the pin is guided in a hollow of a pin mount, the pin mount providing a slide bearing. The materials of pin and pin mount may be chosen to allow for self-lubrication. While it may be possible to manufacture pin and pin mount by machining a metal block, a plastic block or a ceramic block to achieve very low tolerance so that the inner hollow of the pin mount can precisely receive the pin, it may be less costly to realize at least the hollow pin mount from a thermoplastic material so that the hollow pin mount can be made by plastic injection molding, where many pin mounts can be made in parallel and with a low cycle time. The hollow in such an injected pin mount may then be differently shaped than the pin. E.g. the pin may have a circular cross section and the hollow of the pin mount may have a polygonal, e.g. a hexagonal cross section. In some embodiments, the pin mount has at least two in particular oppositely arranged guiding surfaces that guide the pin. Additionally, the pin mount may have at least four guiding surfaces where two guiding surfaces are disposed at a first longitudinal position and two guiding surfaces are arranged at a second longitudinal position, respectively. By such an arrangement, the pin is guided at two positions along its length extension, leading to a precise linear guidance and a relief for the design of the pin mount as the pin mount does not need to guide the pin along its complete length inside of the pin mount. The hollow in the pin mount may be realized as a blind hole. Instead of a pure blind hole, the hollow may continue as a smaller diameter bore, which bore may be used in the step of mounting the spring element.

The spring element may at least partially be arranged in a hollow of the pin where the hollow in the pin may be concentric with the longitudinal axis of the pin. The spring element may generally be realized as a coil spring. One end of the spring element may abut an abutting surface of the hollow in the pin and a second end of the spring element may abut an abutting surface in the hollow of the pin mount. The abutting surface in the pin mount may be precisely dimensioned to tightly receive the second end of the spring element so that the second end of the spring element cannot move with respect to the pin mount. The abutting surface in the pin mount may be provided by a recess in the pin mount. As was already indicated, the hollow may continue as a smaller diameter bore. A metal pin may be slid through the smaller diameter bore, on which pin the spring element (e.g. the coil spring) may be mounted until the pin that compresses the spring element is mounted in the hollow. The metal pin may be retracted from the smaller diameter bore once the mounting of pin and spring element has happened.

The hollow in the pin mount may be defined by a precisely machined core in the plastic injection molding of the pin mount. In particular the guiding surfaces (i.e. the distance between the guiding surfaces) of the hollow may then be realized with high quality, e.g. a tolerance of ±0.03 mm may be applied for the guiding surfaces. The same or a similar low tolerance may be applied for the respective cooperating outer surface portions of the pin itself, so that the pin is finally guided with high precision and with neglectable play or gaps.

The pin head or the cam element may be made at least in the area of the contact surface of the pin or the cam surface from one of the following materials: a plastic material, in particular a hard plastic material having a Shore D hardness of at least 40, further in particular a reinforced plastic material; a lightweight metal or a metal alloy having a specific density in the range of between 2 g/cm$^3$ and 5 g/cm$^3$ such as titanium or aluminum; a heavy metal or a metal alloy having a specific density in the range of between 5 g/cm$^3$ and 20 g/cm$^3$ such as steel, brass, or bronze; or a ceramic material such as silicon carbide or tungsten carbide.

FIG. 1 is a depiction of an example embodiment of a personal care device 1 realized as a mechanical epilator. The personal care device 1 comprises a detachable attachment 10 and a handle 20. The detachable attachment 10 comprises a treatment head 100 that is arranged to be pivotable with respect to a body 200 of the personal care device 1 around a pivot axis A so that the treatment head 100 can pivot into a clockwise direction and a counter-clockwise direction around the pivot axis A as is indicated by double arrow R1. The treatment head 100 is here realized as an epilation head that comprises a treatment head housing 101 and a treatment unit 120 realized as a mechanical epilation cylinder. In the shown example, the treatment head 100 comprises a skin contact element 110 that is arranged to be pivotable around a pivot axis S as is indicated by double arrow R2. The pivot axis S is aligned with a center axis of the rotatable mechanical epilation cylinder 120. The additional pivotable skin contact element 110 is an optional feature. A collar 180 is fixedly connected with the head housing 101 of the treatment head. The collar 180 is arranged to immerse into a frame 190 when the treatment head 100 is pivoted around the pivot axis A. In the shown embodiment, the frame 190 is a part of the detachable attachment 10 but is fixedly secured to the handle 20 in the attached state by in particular a mechanical fixation means such as one or several snap hooks. Hence, while the frame 190 is part of the detachable attachment 10, it is fixedly secured to the handle 20, i.e. does not pivot or move when the treatment head is moved, and the handle 20 and the frame 190 together form the body 200 of the personal care device 1. In another embodiment, only the treatment head may be realized as detachable attachment and frame and collar are provided at the handle. In another embodiment, the treatment head together with the collar form the detachable attachment and the frame is realized as a portion of the handle.

The handle 200 has a handle housing 201 that may house a battery or a rechargeable accumulator and a drive unit for driving the treatment unit 120. In some embodiments, the treatment unit is not driven and may only be supplied with electric energy. In some embodiments, the treatment unit is driven and is supplied with energy. In some embodiments, the treatment unit is neither actively driven nor supplied with energy. The handle 200 may comprise one or several switches 210 such as an ON/OFF switch or a mode switch etc. The handle may comprise any other feature that a skilled person would provide at a handle, e.g. a light source 220 for illuminating the area to be treated.

Figure 2:
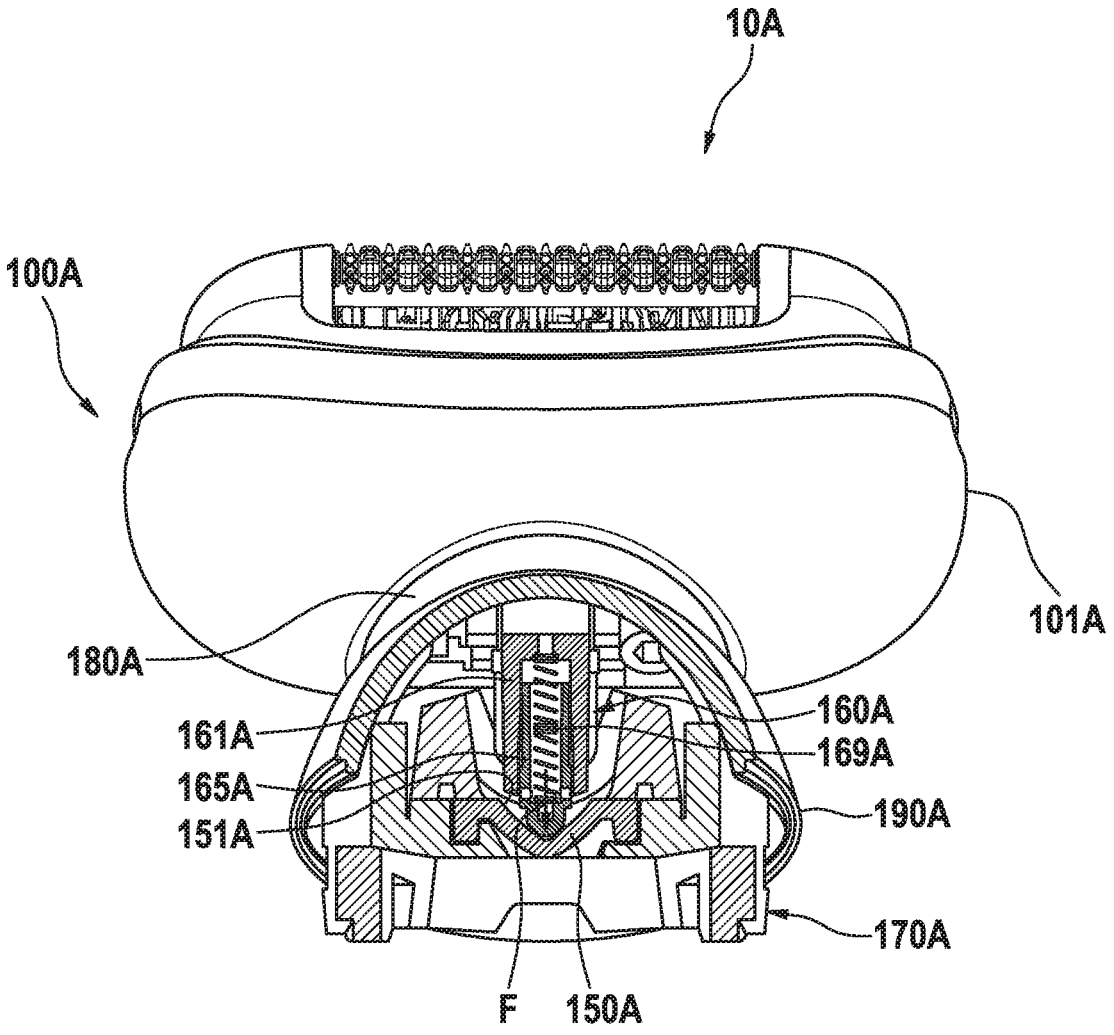
FIG. 2 is a depiction of a detachable attachment of a personal care device, the attachment shown partially cut open so that a spring-loaded pin and a cam element having a cam surface are visible.

FIG. 2 is a depiction of an example partly cut-open detachable attachment 10A comprising a treatment head 100A having a treatment head housing 101A to which a collar 180A is fixedly mounted. A frame 190A is pivotably arranged with respect to the treatment head 100A and collar 180A. A support structure 170A is mounted at the frame 190A. The support structure 170A and/or the frame 190A has coupling means for coupling the detachable attachment 10A to a handle of a personal care device as was discussed with respect to FIG. 1. The support structure 170A carries a cam element 150A. A pin unit 160A is fixedly mounted at the treatment head 100A and/or collar 160A. The pin unit 160A comprises a pin mount 161A and a pin 165A, where a spring element 169A is disposed between the pin mount 161A and the pin 165 A. The pin 165A is in contact with a cam surface 151A of the cam element 150A. The pin 165A is here shown in a rest position. The spring element 169A, which is here realized as a coil spring, is compressed and thus pushes the pin 165A against the cam surface 151A of the cam element 150A with a predetermined biasing force F. The technical design of the pin unit 160A and the interaction between the pin 165A and the cam element 150A will be explained in more detail in the following with reference to FIGS. 3A, 3B, 4A, and 4B. As was mentioned above, while the embodiment discussed with respect to the figures show a spring-loaded pin, it is as well contemplated that the cam element is spring-loaded, and that the cam element may then be guided by a linear guide.

Figure 3A:
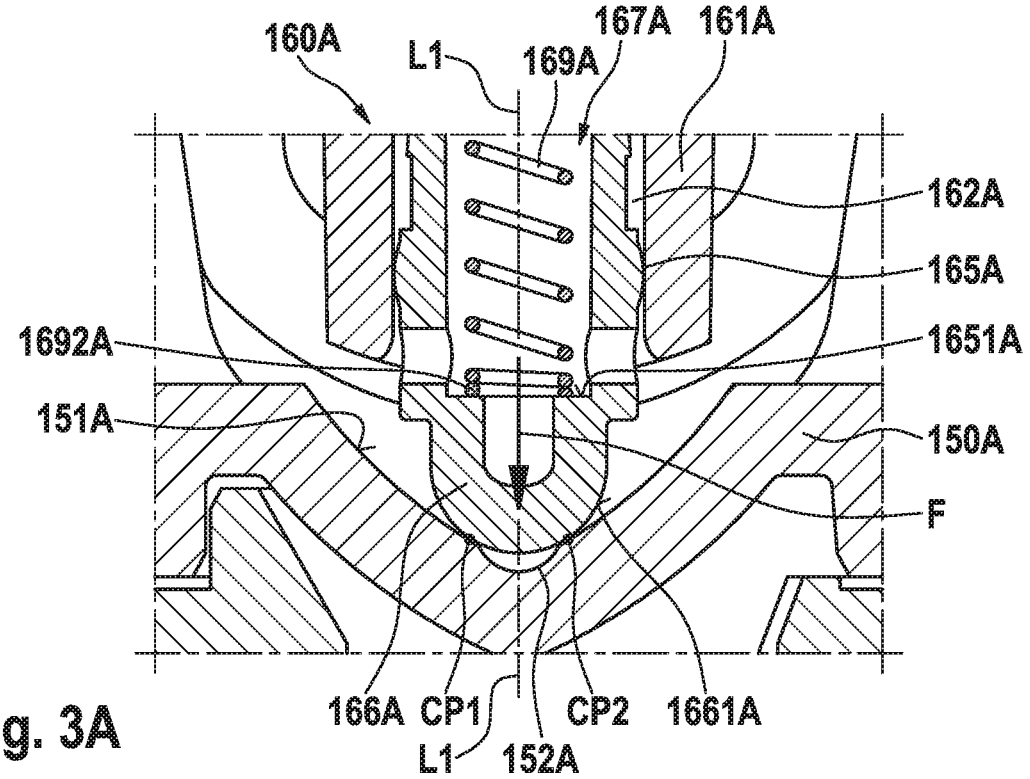
FIG. 3A is a detail of a cross-sectional view of the spring-loaded pin and the cam element shown in FIG. 2, where the spring-biased pin is in a center or rest position.

FIG. 3A is a detail cross-sectional view of the pin unit 160A and cam element 150A when the pin 165A is in a rest position. As was already explained, the pin unit 160A comprises a pin mount 161A having a hollow 162A, which will be more in detail described with reference to FIGS. 4A and 4B, a pin 165A disposed partly in the hollow 162A and a spring element 169A that biases a pin head 166A against a cam surface 151A of the cam element 150A with a biasing force F. The pin 165A has a centrical hollow or bore 167A in which the spring element 169A is disposed. The spring element 169A is here realized as a coil spring, which shall not exclude other realization, e.g. the spring element may be an elastically deformable resilient rubber element. One end 1692A of the spring element 169A abuts an abutting surface 1651A provided in the hollow 167A.

Figure 3B:
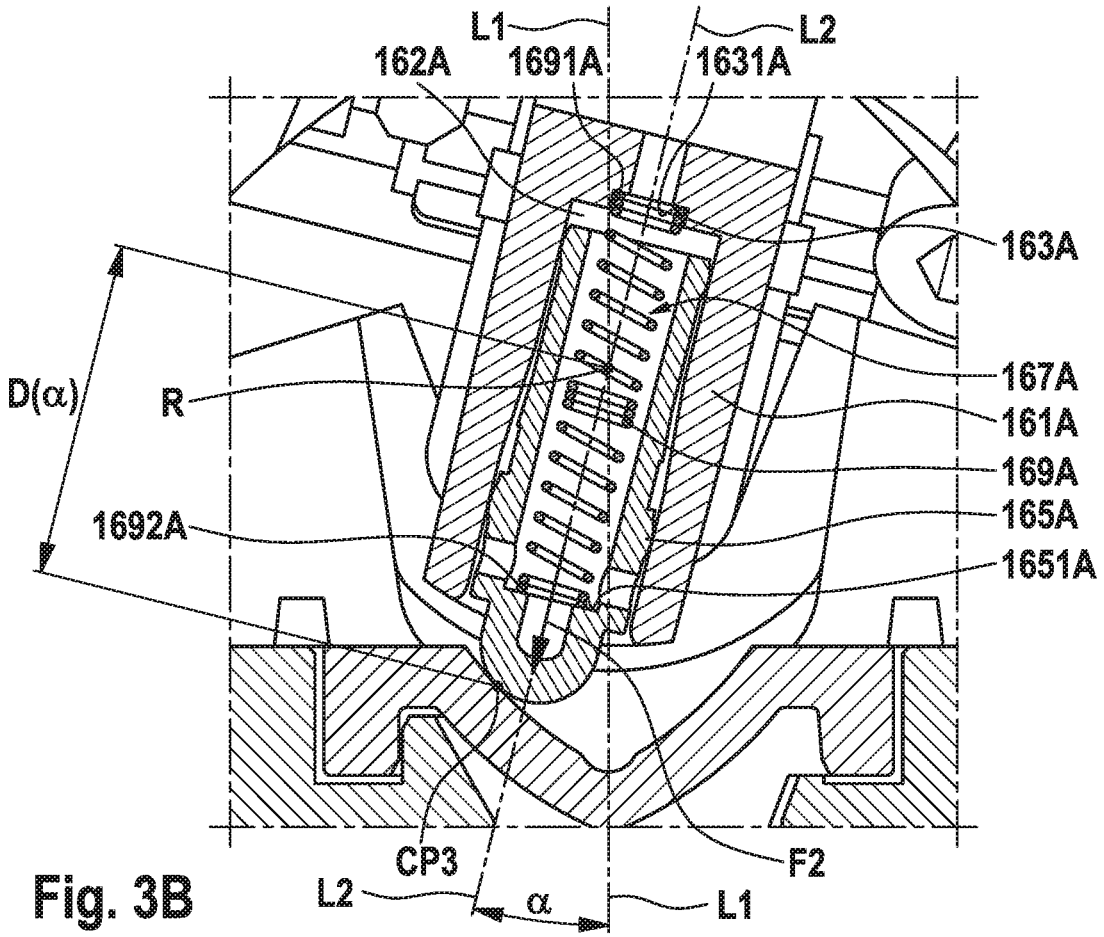
FIG. 3B is a detail of a cross-sectional view of the spring-loaded pin and the cam element, where the pin is in a pivoted position and the spring element is in a more compressed state.

The pin head 166A has an outer contact surface 1661A that is in frictional contact with a cam surface 151A. The cam surface 151A of the cam element 150A defines a rest position of the pin unit 160A. In order to pivot the pin unit 160A out of the rest position, the pin head 166A must move along the cam surface 151A, which is shaped such that the pin 165A will be moved towards a pivot axis R with increasing pivot angle as shown in FIG. 3B, which leads to a compression of the spring element 169A and hence to an increase of the force F with which the pin head 161A is pushed against the cam element 150A. The cam element 150A has a depression 152A that is arranged centrically on the cam element 150A, i.e. it is arranged centrically with respect to an axis L1 defining the rest position. Without the central depression 152A, the right-hand side cam surface and the left-hand side cam surface would meet under an acute angle. The contact surface 1661A of the pin head 166A is cylindrical at least in those areas that will come into contact with the cam surface 151A. The size of the depression 152A is smaller than the extension of the contact surface 1661A of the pin head 166A so that the pin head 166A contacts the cam element 150A at two contact points CP1 and CP2 on the left and the right of the depression 152A (as the cam surface 151A and the contact surface 1661A extend in three-dimensional space, the contact points CP1 and CP2 are essentially contact lines or contact areas, but for sake of simplicity, it is here referred to as contact points). In particular, the depression 152A is dimensioned such that the contact points CP1 and CP2 are located just at the border of the depression 152A. The depression 152A tends to balance tolerances in the parts.

In the shown realization, the cam element 150A and the cam surface 151A are symmetric with respect to the rest position so that the rest position is also a center position. To avoid that the pin head 166A is pivoted over an end of the cam element 150A, the personal care device may comprise stopper elements that inhibit any pivoting beyond a maximum pivot angle. The personal care device may comprise two such stopper elements, where one stopper element is limiting the pivot range in clockwise direction and the other stopper element is limiting the pivot range in counter-clockwise direction, where clockwise and counter-clockwise is defined with respect to the paper plane. While the cam element 150A is here symmetric, the stopper elements may provide for non-symmetric pivot ranges in clockwise and counter-clockwise direction.

The pin 165A may comprise an extension that is arranged in a groove or cutout of the pin mount 161A (or vice versa) so that the pin 165A is secured at the pin mount 161A during the assembly process.

In FIG. 3B a somewhat larger detail of the pin unit 160A and cam element 150A is shown, where the pin unit 160A is shown in a clockwise pivoted state. The longitudinal extension direction of the pin unit 160A is indicated by axis L2, which is pivoted against the rest position axis L1 by a pivot angle $\alpha$. As the pin unit is secured with respect to the treatment head, the shown pivoting state of the pin unit 160A of course means that the treatment head is likewise pivoted by the pivot angle $\alpha$ against the body of the personal care device. The pivoting occurs around a pivot axis R that is defined by a bearing and/or linkage that pivotably connects the treatment head and the body of the personal care device, e.g. the treatment head and the body may be pivotably connected by means of a cardan joint. The contact surface 1661A of the pin head 166A is in contact with the cam surface 151A at a contact point CP3. The contact point CP1 on the contact surface 1661A of the pin head 166A shown in FIG. 4A slightly moves when the pin 165A is pivoted out of the rest position. Obviously, the pin head 165A has only one contact point CP3 with the cam element 150A once it is pivoted out of the rest position. The cam surface 151A is shaped such that the distance $D(\alpha)$ between the contact point CP3 and the pivot axis R monotonously decreases with increasing pivot angle $\alpha$. Due to this decreasing distance $D(\alpha)$, the pin 165A is moved towards a blind hole end of the hollow 167A of the pin mount 161A and as a consequence, the spring element 169A is compressed, which leads to an increase in the force F2 with which the pin head 166A is pushed against the cam element 150A. This increasing biasing force results in a return force that tries to return the pin unit 160A back into its rest position. An end 1961A of the spring element 169A opposite to the end 1692A abuts an abutting surface 1631A that is provided in a recess 163A provided in the blind hole end of the hollow 162A of the pin mount 161A. The recess 163A is dimensioned such that the end 1961A of the spring element 169A is essentially tightly received in the recess 163A and thus cannot move.

As was said, the cam surface is shaped in a manner that results in a monotonous decrease of the distance $D(\alpha)$ between the contact point CP3 and the pivot axis R with increasing pivot angle $\alpha$. In some embodiments, the mathematical relation can be expressed by a linear equation:

$$D(\alpha)=D_0-k\cdot\alpha,$$

where $D_0$ is the distance in the rest position and k is a slope factor that defines how fast the distances decreases per pivot angle, i.e. $k=\Delta D/\Delta\alpha$. This shall of course not exclude that the cam surface can take other shapes, i.e. a shape where the distance decreases in a potential manner or a shape supporting an intermediate locking position at a lock angle.

The materials from which the pin head 166A are made at least in the area of the contact surface 1661A and the cam element 150A at least in the area of the cam surface 151A may be chosen such that the friction between the two parts does not lead to self-locking. In particular, the friction coefficient between both materials may be chosen to be below 0.4, in particular below 0.35 such as 0.3 or 0.25 or 0.2. As was said in a previous paragraph, the pin head may be realized as a cylinder or a sphere that is pivotably mounted at the pin and thus self-locking issues may be overcome.

Figure 4A:
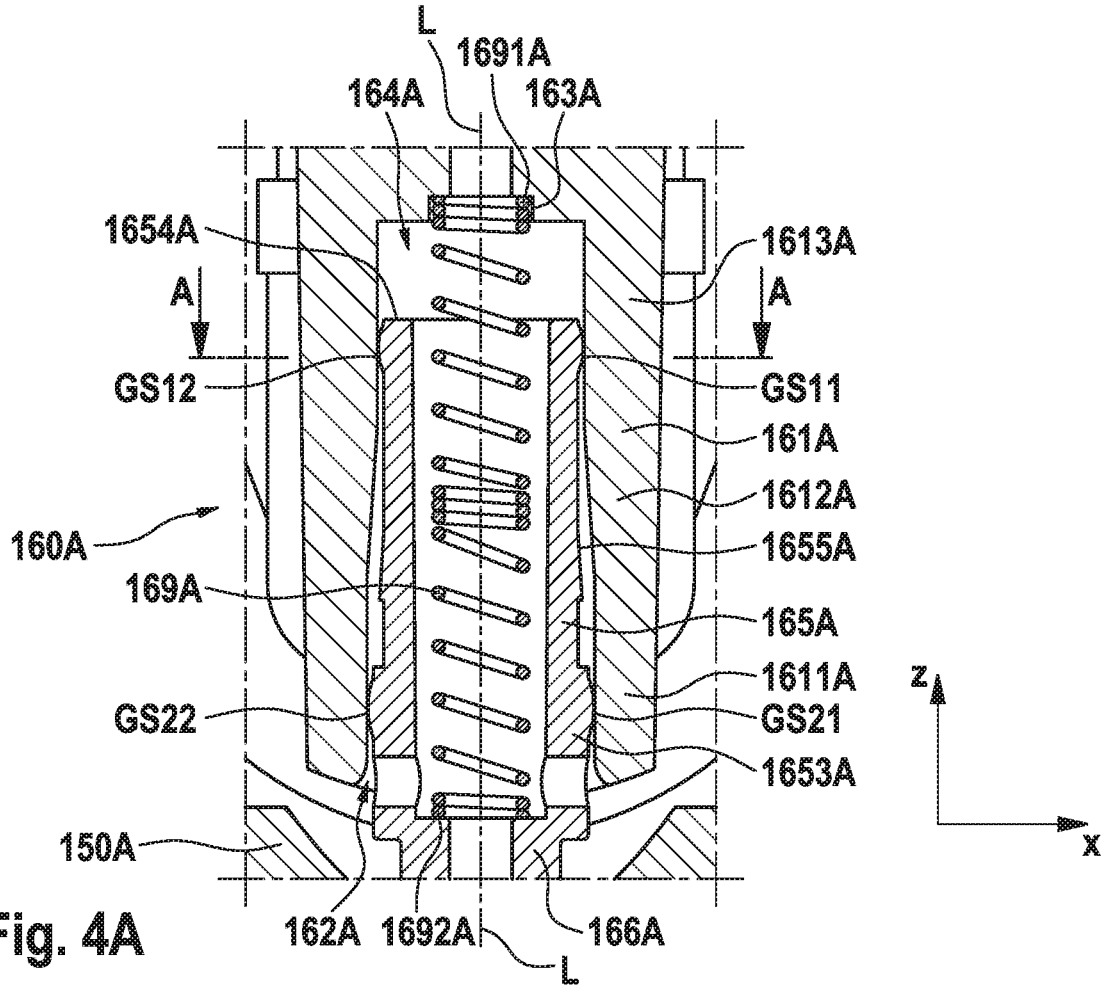
FIG. 4A is a detail of a cross-sectional view of the spring-loaded pin guided in a pin mount.
Figure 4B:
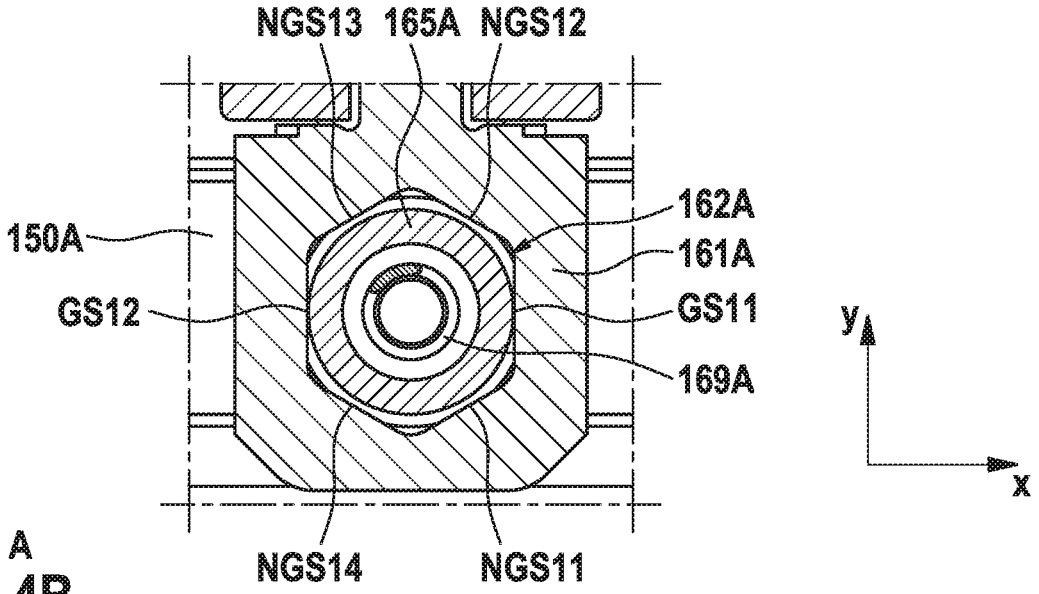
FIG. 4B is a detail of a cross-sectional view of the pin and the pin mount shown in FIG. 4A taken in a plane A-A being perpendicular to the cross-section of FIG. 4A, where the viewing plane A-A is indicated in FIG. 4A.

Generally, it shall not be excluded that the pin fits smoothly into the pin mount. E.g. the pin and the pin mount may be precisely shaped aluminum parts or the like and they may be lubricated with a suitable lubricant. With reference to FIGS. 4A and 4B an example embodiment of the pin unit 160A comprising the pin 165A and the pin mount 161A is discussed that allows making the parts by plastic injection molding, where the tolerances are higher than in a metal shaping process and where the manufacturing process enforces certain necessities such as deforming angles that are accommodated by the design. In this embodiment, the pin 165A and the pin mount 161A are not realized as parts that smoothly fit into each other, but where still a good guiding quality of the linear motion of the pin 165A is achieved. FIG. 4A is a cross-sectional detail of the pin unit 160A and FIG. 4B is another cross-sectional detail of the pin unit 160A taken along plane A-A as indicated in FIG. 4A.

The pin unit 160A comprises the pin mount 161A, the pin 165A and the spring element 169A. With respect to the spring element 169A it is referred to the previous paragraphs. The pin 165A is guided by the pin mount 161A. The pin mount 161A has a hollow 162A realized as a bore having a blind hole end 164A. As can be seen from FIG. 4A, the hollow 162A in the pin mount 161A tapers from its open end at the front of the pin mount 161A where the pin 165A projects towards the cam element 150A to the blind hole end 164A. This tapering is necessary to allow deforming the pin mount 161A from a core defining the hollow 162A at the end of a plastic injection molding process. Instead of a uniform tapering from the front to the blind hole end 164A, the draft angle is varied over the longitudinal extension length of the hollow 162A. From front towards blind hole end 164A, the draft angle is first very small in a front region 1611A, then the draft angle is relatively large in a middle region 1612A, and the draft angle becomes very small again in a blind hole end region 1613A. In the regions 1611A and 1613A with the low draft angle, guiding surfaces are provided that have a low specified tolerance. In region 1611A, which is in longitudinal extension direction located close to the front of the pin mount 161A, two oppositely arranged guiding surfaces GS21 and GS22 are provided. In region 1613A, which is in longitudinal extension direction located close to the blind end hole 164A of the pin mount 161A, two oppositely arranged guiding surfaces GS11 and GS12 are provided.

The pin 165A is also generally tapering from a front region 1653A to a back-end region 1654A. But as was described for the hollow 162A of the pin mount 161A, the pin 165A has low tolerance areas at the front and at the back that coincide in the mounted state with the longitudinal locations of the guiding surfaces in the hollow 162A. As can best be seen in FIG. 4B, the pin 165A has an essentially circular cross-sectional outer shape and the hollow 162A has an essentially hexagonal cross-sectional inner shape. Thus, the guiding surfaces, of which GS11 and GS12 are shown in FIG. 4B, provide an essentially line-like guiding contact with the pin 165A. Non-guiding surfaces NGS11 to NGS14 are provided with a nominal distance to the pin 165A. The same type of arrangement is provided in the front region 161A. That leads to a precise guiding of the pin's movement in z direction (where the z-direction is indicated in FIG. 4A) and a precise location of the pin 165A in x-direction. The contact of the pin 165A with the cam element 150A avoids that the pin 165A can tilt and only some freedom of motion in y-direction is allowed (the y-direction is indicated in FIG. 4B).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A personal care device with a treatment head being pivot-mounted around a pivot axis with respect to a body of the personal care device, the personal care device comprising:

a pin having a pin head, the pin being provided at one of the treatment head or body;

a cam element having a cam surface being provided at the other one of the treatment head or body;

a spring element biasing the pin head and the cam surface against each other;

wherein the pin head is in contact with the cam surface and the cam surface is shaped such that it defines a rest position at which a biasing spring force provided by the spring element with which the pin head and the cam surface are pushed against each other has a non-zero minimum value;

wherein a pivoting of the treatment head around the pivot axis causes the pin head to move along the cam surface and the cam surface is further shaped such that the biasing spring force pushing the pin head and the cam surface against each other increases with increasing pivoting angle; and wherein the pin head has a contact surface for contacting the cam surface, which contact surface is at least a portion of a spherical surface or of a cylindrical surface and the cam surface has a depression to define the rest position, the depression being smaller than a diameter of the sphere defining the spherical surface or of the cylinder defining the cylindrical surface.

2. The personal care device according to claim 1, wherein the pin is guided in a hollow of a pin mount.

3. The personal care device according to claim 1. wherein a pin mount has at least four guiding surfaces for guiding the pin where two oppositely arranged guiding surfaces are provided at a first longitudinal position in the pin mount and two further oppositely arranged guiding surfaces are arranged at a second longitudinal position.

4. The personal care device according to claim 1, wherein a pin portion guided by a pin mount has an essentially circular cross-sectional shape and a portion in the pin mount for guiding the pin has an essentially polygonal cross-sectional shape.

5. The personal care device according to claim 1, wherein a pin mount and the guided parts of the pin have at least in the area where the pin is guided by the pin mount a tolerance of about ±0.03 mm or below.

6. The personal care device according to claim 1, wherein the spring element is partly arranged in a longitudinally extending centric hollow in the pin and partly in a hollow of a pin mount.

7. The personal care device according to claim 1, wherein the spring element is a longitudinally extending coil spring that has a first end that is arranged in a recess of a pin mount, the recess being dimensioned to confine the first end so that the first end can essentially not move.

8. The personal care device according to claim 1, wherein the cam surface has a generally concave shape that tapers towards a cam surface portion that defines the rest point position.

9. The personal care device according to claim 8, wherein the cam surface is symmetrically shaped with respect to the rest position.

10. The personal care device according to claim 1, wherein at least the pin head is made from one of the following materials: a hard plastic material having a Shore D hardness of at least 40; a lightweight metal or a metal alloy having a specific density in the range of between about 2 $g/cm^3$ and about 5 $g/cm^3$; a heavy metal or a metal alloy having a specific density in the range of between about 5 $g/cm^3$ and about 20 $g/cm^3$.

11. The personal care device according to claim 1, wherein at least the cam surface is made from one of the following materials: a hard plastic material having a Shore D hardness of at least 40; a lightweight metal or a metal alloy having a specific density in the range of between about 2 $g/cm^3$ and about 5 $g/cm^3$; a heavy metal or a metal alloy having a specific density in the range of between about 5 $g/cm^3$ and about 20 $g/cm^3$; ceramic material.

12. The personal care device according to claim 1, wherein the spring constant of the spring element is in a range of between about 0.05 N/mm and about 1.0 N/mm.

13. The personal care device according to claim 1, wherein the biasing force with which the pin head is pushed against the cam surface increases from the a center position to a maximum pivot angle position by a factor in the range of between about 1.025 to about 1.5.

14. The personal care device according to claim 1, wherein the biasing force with which the pin head is pushed against the cam surface in the rest position is in the range of between about 0.5 N and about 8 N.

15. A personal care device with a treatment head being pivot-mounted around a pivot axis with respect to a body of the personal care device, the personal care device comprising:

a pin having a pin head, the pin being provided at one of the treatment head or body;

a cam element having a cam surface being provided at the other one of the treatment head or body;

a spring element biasing the pin head and the cam surface against each other;

wherein the pin head is in contact with the cam surface and the cam surface is shaped such that it defines a rest position at which a biasing spring force provided by the spring element with which the pin head and the cam surface are pushed against each other has a non-zero minimum value;

wherein a pivoting of the treatment head around the pivot axis causes the pin head to move along the cam surface and the cam surface is further shaped such that the biasing spring force pushing the pin head and the cam surface against each other increases with increasing pivoting angle; and wherein the cam surface is defined by a function with respect to the pivot axis that is given the formula $D(\alpha)=D_0-\Delta D\cdot(\alpha/\Delta\alpha)$, where D is the distance of a contact point of the pin head and the cam surface to the pivot axis, $\alpha$ is the pivot angle with respect to the rest position, $D_0$ is the respective distance in the rest position, and $\Delta D$, and $\Delta\alpha$ are parameters that define the slope of the function.

* * * * *